US011491412B2

(12) United States Patent
Cao

(10) Patent No.: US 11,491,412 B2
(45) Date of Patent: Nov. 8, 2022

(54) TOY VEHICLE BOOSTER

(71) Applicant: Mattel, Inc., El Segundo, CA (US)

(72) Inventor: Kevin Cao, Reseda, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 17/164,880

(22) Filed: Feb. 2, 2021

(65) Prior Publication Data

US 2021/0236947 A1 Aug. 5, 2021

Related U.S. Application Data

(60) Provisional application No. 62/970,219, filed on Feb. 5, 2020.

(51) Int. Cl.
*A63H 18/02* (2006.01)
*A63H 17/00* (2006.01)

(52) U.S. Cl.
CPC ..... *A63H 18/026* (2013.01); *A63H 17/008* (2013.01); *A63H 18/028* (2013.01)

(58) Field of Classification Search
CPC ..... A63H 18/026; A63H 18/00; A63H 18/02; A63H 17/008; A63H 18/028
See application file for complete search history.

(56) References Cited

U.S. PATENT DOCUMENTS 3,590,524 A * 7/1971 Beny ..... A63H 18/14 104/168
3,641,704 A * 2/1972 Sims ..... A63H 18/14 124/78
3,699,711 A * 10/1972 Coffey, Sr. ..... A63H 18/14 463/68
3,777,394 A 12/1973 Staats
4,174,587 A * 11/1979 Morin ..... A63H 18/026 74/543
4,349,983 A 9/1982 Kilroy
4,433,504 A * 2/1984 Terui ..... A63H 17/44 446/429
4,472,008 A * 9/1984 Pearlstein ..... A63H 33/00 312/305
4,698,042 A * 10/1987 Rubin ..... B65D 81/36 446/160
4,937,207 A 6/1990 Simmell
(Continued)

FOREIGN PATENT DOCUMENTS

GB 2321204 A * 7/1998 ..... A63H 19/36
JP 2000296885 A * 10/2000

*Primary Examiner* — Eugene L Kim
*Assistant Examiner* — Alyssa M Hylinski
(74) *Attorney, Agent, or Firm* — Edell, Shapiro & Finnan, LLC

(57) ABSTRACT

A toy vehicle booster is presented herein. The toy vehicle booster includes a booster assembly that is integrated into a lid of a track storage container so that the toy vehicle booster forms a portion of a storage container for a track set. In some instances, the booster assembly includes a first booster and a second booster. The first booster may accelerate toy vehicles along a first pathway and the second booster may accelerate toy vehicles along a second pathway. In at least some of these embodiments, at least the second booster may be reversible so that the second booster can accelerate toy vehicles along the second pathway in a first direction or a second direction opposite the first direction.

20 Claims, 11 Drawing Sheets

(56) References Cited

U.S. PATENT DOCUMENTS

| | | | | |
|---|---|---|---|---|
| 5,052,972 | A | 10/1991 | Suimon | |
| D393,495 | S * | 4/1998 | Blumenthal | D3/276 |
| 5,749,547 | A * | 5/1998 | Young | A63H 19/24 246/4 |
| 6,695,675 | B1 * | 2/2004 | Ngan | A63H 17/008 446/444 |
| 6,793,554 | B1 | 9/2004 | Newbold | |
| 7,387,559 | B2 | 6/2008 | Sanchez-Castro | |
| 7,637,796 | B2 | 12/2009 | Hippely | |
| 7,892,068 | B2 | 2/2011 | Nuttall | |
| 7,955,158 | B2 * | 6/2011 | Filoseta | A63H 18/14 446/444 |
| 8,011,994 | B2 | 9/2011 | Fink | |
| 8,366,508 | B2 | 2/2013 | Filoseta | |
| 8,449,344 | B2 | 5/2013 | Nuttall | |
| 8,668,081 | B2 | 3/2014 | Hippely | |
| 8,790,152 | B2 * | 7/2014 | Schlegel | B62K 9/00 446/478 |
| 9,579,583 | B2 | 2/2017 | Sheltman | |
| 9,586,155 | B2 | 3/2017 | Hong | |
| 10,369,486 | B2 | 8/2019 | Santos | |
| 2006/0148373 | A1 | 7/2006 | Vetuskey | |
| 2009/0253349 | A1 | 10/2009 | Iwakoshi | |
| 2010/0304639 | A1 | 12/2010 | Payne | |
| 2011/0081823 | A1 * | 4/2011 | Christopherson | A63H 33/044 446/75 |
| 2012/0208431 | A1 | 8/2012 | Screnci | |
| 2013/0078887 | A1 | 3/2013 | Payne | |
| 2015/0343319 | A1 | 12/2015 | O'Connor | |
| 2016/0318675 | A1 * | 11/2016 | Chan | B65D 51/245 |
| 2018/0333651 | A1 | 11/2018 | Choi | |
| 2019/0060772 | A1 | 2/2019 | Hamel | |
| 2019/0224580 | A1 | 7/2019 | Schmid | |

* cited by examiner

TOY VEHICLE BOOSTER

CROSS-REFERENCE TO RELATED APPLICATIONS

This application claims priority to and the benefit of U.S. Provisional Patent Application No. 62/970,219 filed Feb. 5, 2020, and entitled "Toy Vehicle Booster," the disclosure of which is incorporated herein by reference in its entirety.

FIELD OF THE INVENTION

The present application relates generally to toy vehicles and, in particular, to toy vehicle boosters and/or toy vehicle track sets including a booster.

BACKGROUND

Conventional toy vehicle track sets include one or more sections of track along which a toy vehicle can travel. In some track sets, accessories, such as boosters, will act on a toy vehicle as, before, or after the toy vehicle is traveling along the track. However, children often grow tired of playing with the same accessories and/or with the same toy vehicles. Moreover, track sets containing multiple track segments may be difficult to transport and store, especially if a child continues to add more accessories to their track set. Consequently, toy vehicle accessories, such as boosters, that provide new and interesting play features and/or that can be easily transported and stored with other track set pieces are continuously desired.

SUMMARY

At least a toy vehicle booster and a container for a toy vehicle track set are presented herein. According to one example embodiment, the toy vehicle booster includes a booster assembly that is integrated into a lid of a storage unit or case so that the toy vehicle booster forms a portion of the storage container. In some instances, the booster assembly includes a first booster and a second booster. The first booster may accelerate toy vehicles along a first pathway and the second booster may accelerate toy vehicles along a second pathway. In at least some of these embodiments, at least the second booster may be reversible so that the second booster can accelerate toy vehicles along the second pathway in a first direction or a second direction that is opposite the first direction.

According to another example embodiment, a toy vehicle track set includes a container and a lid. The lid is removably coupleable to the container and, when the lid is removably secured to the container, the container and lid provide an enclosed storage space for track pieces and/or toy vehicles that are included in or being used with the toy vehicle track set. The lid also includes an integrated booster assembly. In at least some embodiments, the lid includes latches that allow the lid to be removably coupled to the container.

Other systems, methods, features and advantages will be, or will become, apparent to one with skill in the art upon examination of the following figures and detailed description. All such additional systems, methods, features and advantages are included within this description, are within the scope of the claimed subject matter.

BRIEF DESCRIPTION OF THE DRAWINGS

The toy vehicle booster presented herein may be better understood with reference to the following drawings and description. It should be understood that the elements in the figures are not necessarily to scale and that emphasis has been placed upon illustrating the principles of the toy vehicle booster. In the figures, like-referenced numerals designate corresponding parts throughout the different views.

DETAILED DESCRIPTION

Overall, a toy vehicle booster and a lid including a toy vehicle booster are presented herein. The vehicle booster is an electrically-powered toy vehicle booster and is integrated into a lid that may close a container to store track pieces and/or toy vehicles. Thus, the booster need not be stored within the container and the container can be easily transported with a maximum amount of other track pieces and/or toy vehicles stored therein. Additionally, the lid may increase the play value of track sets provided in containers by providing an electrically powered toy vehicle booster to continuously and/or automatically accelerate vehicles, even if such a booster might not have otherwise fit within the container.

In some instances, the toy vehicle booster presented herein includes a first booster and a second booster, each of which include a pair of motor-driven rotating wheels on either side of a track portion or pathway. The motor-driven rotating wheels engage with and boost a toy vehicle passing therethrough. That is, the first booster may accelerate toy vehicles along a first pathway and the second booster may accelerate toy vehicles along a second pathway. In at least some of these embodiments, at least the first booster may be reversible (i.e., bidirectional) so that the first booster can accelerate toy vehicles along the first pathway in a first direction or a second direction opposite the first direction.

Figure 1:
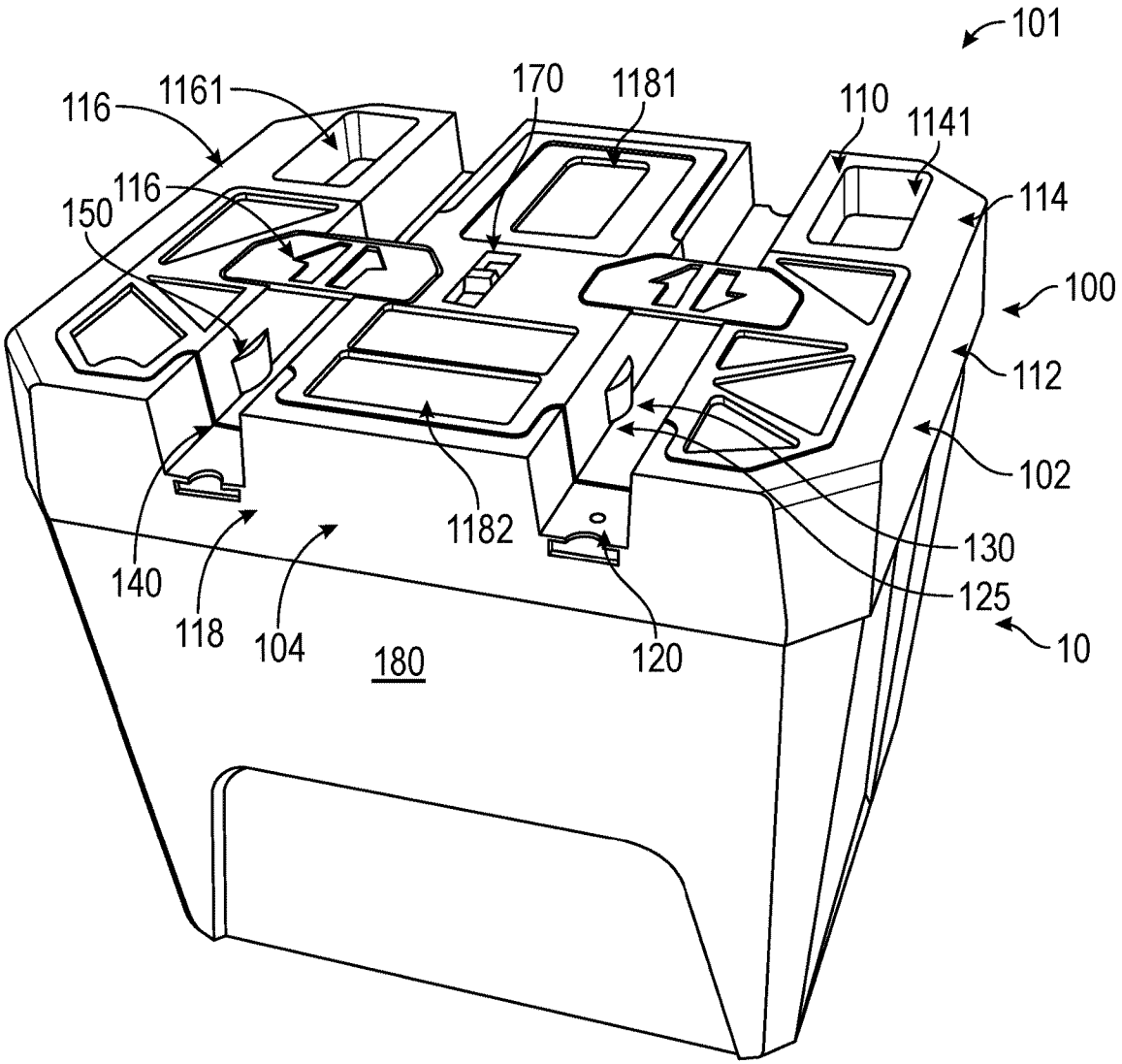
FIG. 1 illustrates a top perspective view of a first toy vehicle track set including a first example embodiment of the lid-integrated toy vehicle booster of the present application.

FIG. 1 illustrate a first example track set 10 that includes a first example embodiment of the lid-integrated toy vehicle booster 100. As is implied by its name, the lid-integrated toy vehicle booster 100 (also referred to herein as toy vehicle booster lid 100) includes a booster 101 that is integrated into a lid 102. The lid 102 is securable to a container 180 to form a storage container or storage solution for the track set 10 and the booster 101 is operable to accelerate toy vehicles passing therethrough. In the depicted embodiment, the toy vehicle booster 101 is formed integrally with the lid 102 so that toy vehicle booster 101 is not removable or otherwise separable from the lid 102. That is, the toy vehicle booster 101 and lid 102 are one piece or one unified unit. However, in other embodiments, the toy vehicle booster 101 may be removably coupled to the lid 102. For example, the toy vehicle booster 101 may be mountable within one or more recesses and/or pathways defined by lid 102.

In the depicted embodiment, the lid 102 includes a body portion 110 that extends from a front 104 to a back 106 and from a first side 108 (e.g., right side 108) to a second side 109 (e.g., a left side). The body portion 110 defines pathways or track paths that extend from the front 104 to the back 106. In particular, the lid 102 defines a first pathway 120 and a second pathway 140 that are parallel to each other and to sides 108 and 109.

Moreover, pathways 120 and 140 are defined within the body portion 110 of the lid 102 so that the pathways 120 and 140 are laterally bounded (i.e., formed between sidewalls). Put another way, in the depicted embodiment, the body portion 110 defines vertically oriented interior sidewalls on opposite sides of horizontal surfaces that are beneath the remainder of body portion 110 to define pathways 120 and 140 as sunk or recessed channels. Specifically, first pathway 120 is formed between a first external portion 114 of body portion 110 (adjacent first side 108) and a central portion 118 of body portion 110 while the second pathway 140 is formed between a second external portion 116 of the body portion 110 (adjacent side 109) and the central portion 118. However, in other embodiments, pathways 120 and 140 may extend through lid in any direction or manner, along any path, including linear, arcuate, or irregular paths.

Figure 2:
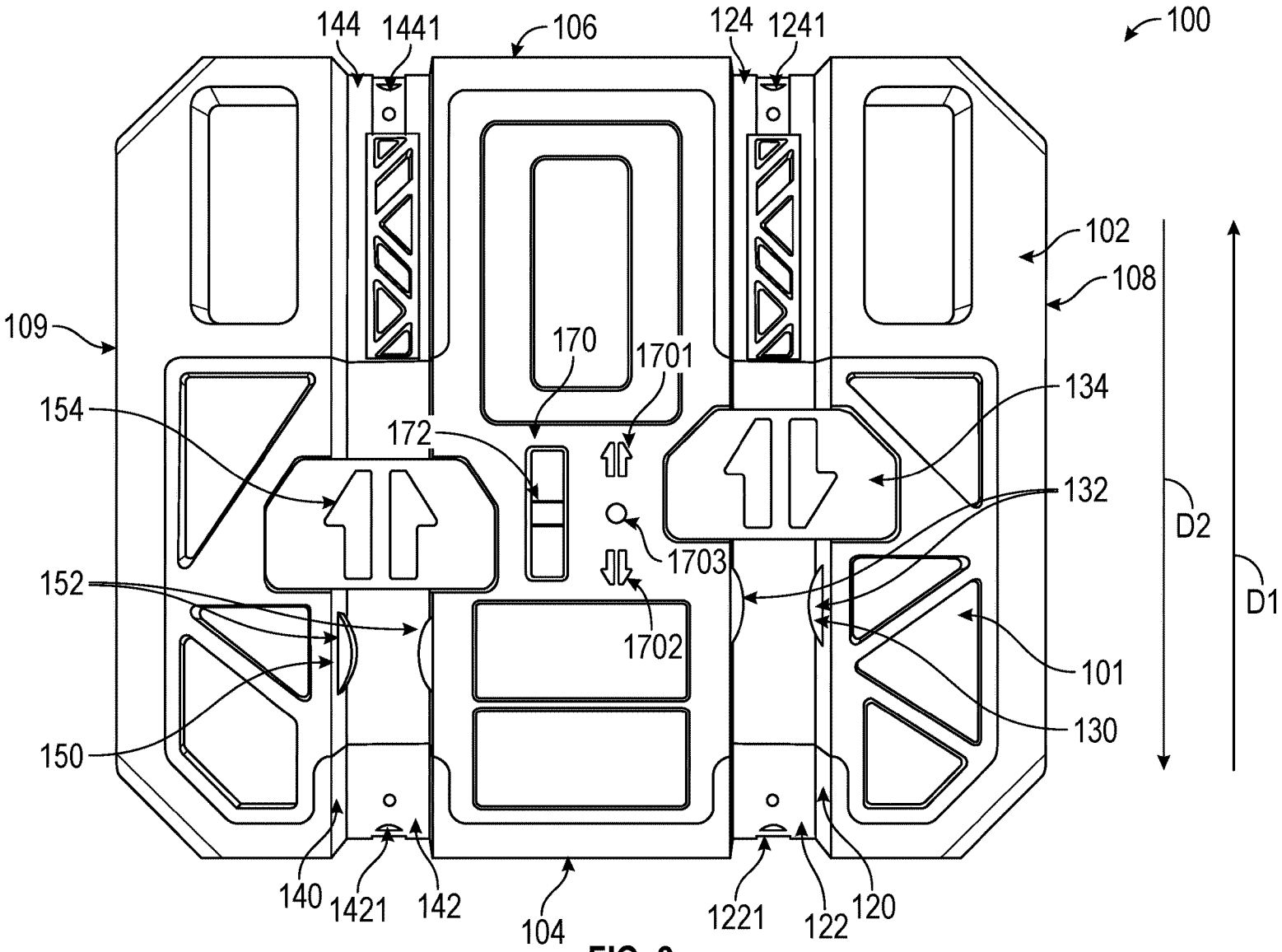
FIG. 2 illustrates a top view of the lid-integrated toy vehicle booster of FIG. 1.

As can be seen in FIGS. 1 and 2, the first pathway 120 of the depicted embodiment extends from a first end 122 adjacent the front 104 of lid 102 to a second end 124 adjacent the back 106 of the lid 102. Similarly, the second pathway 140 of the depicted embodiment extends from a first end 142 adjacent the front 104 of lid 102 to a second end 144 adjacent the back 106 of the lid 102. Thus, a toy vehicle traversing the lid-integrated toy vehicle booster 100 can travel along the first pathway 120 or the second pathway 140 in a first direction D1 (also referred to as a forward direction), from first end 122 or first end 142 to second end 124 or second end 144, respectively. Alternatively, a toy vehicle traversing the lid-integrated toy vehicle booster 100 can travel along the first pathway 120 or the second pathway 140 in a second direction D2 (also referred to as a rearward or opposite direction), from second end 124 or second end 144 to first end 122 or first end 142, respectively.

Each end 122, 124, 142, 144 of pathways 120 and 124 may also include a track connector to allow the lid-integrated toy vehicle booster 100 to connect to other track pieces of track set 10 (or any other track set). The connector may be or include any connection features, but in the depicted embodiment, first ends 122 and 142 each include a female connector: female connector 1221 and female connector 1421, respectively. Meanwhile, second ends 124 and 144 each include a male connector: male connector 1241 and male connector 1441, respectively.

In the depicted embodiment, the first pathway 120 and the second pathway 140 are, for the most part, open-top pathways and are only include a small covered portion covered by cover 134 and cover 154, respectively. That is, the first pathway 120 and the second pathway 140 are uncovered, except that a small portion of each of pathways 120 and 140 is covered by covers 134 and 154. Covers 134 and 154 may, in at least some embodiments, include indicia representative of a direction in which toy vehicles may be accelerated, by booster 130 or 150, along pathway 120 or 140. Moreover, in the depicted embodiment, covers 134 and 154 are positioned adjacent a downstream end of booster 130 and 150 with respect to direction D1 so that covers 134 and 154 may retain a toy vehicle in pathways 120 and 140, respectively, when the toy vehicle is accelerated in direction D1. However, in other embodiments, the first pathway 120 and/or the second pathway 140 may include any number, size, etc. of coverings that cover any portion of first pathway 120 and/or second pathway 140. For example, first pathway 120 may be entirely uncovered while second pathway 140 is entirely covered, or vice versa. As another example, one or both of first pathway 120 and second pathway 140 may include two coverings, positioned adjacent upstream and downstream ends of booster 130 and/or booster 150.

Still referring to FIGS. 1 and 2, in addition to forming pathways 120 and 140, the portions 114, 116, and 118 of the body portion 110 may also define, house, cover, or host additional features of the toy vehicle booster 101. For example, each of portions 114, 116, and 118 can host a portion of a booster assembly 125 of the toy vehicle booster 101, with the first external portion 114 and the central portion 118 partially housing booster wheels 132 of a first booster 130 of the booster assembly 125 and the second external portion 116 and the central portion 118 partially housing booster wheels 152 of a second booster 150 of the booster assembly 125.

Although not shown in detail, it is to be understood that booster wheels 132 and booster wheels 152 may each comprise a pair of linked booster wheels. As is explained in further detail below, in some embodiments, booster wheels 132 and booster wheels 152 may be driven by the same motor or motor assembly. However, in other embodiments, a first motor or motor assembly may drive booster wheels 132 while a second motor or motor assembly drives booster wheels 152. However, regardless of whether booster wheels 132 are linked to booster wheels 152 (e.g., driven by the same motor), any booster wheels 132 included in booster 130 may be linked and any booster wheels 152 included in booster 150 may be linked.

When booster wheels included in booster assembly 125 are linked, they may be linked in any desirable manner. For example, a pair of booster wheels 132 included in booster 130 may be linked to each other via gears. Additionally or alternatively, a pair of booster wheels 132 included in booster 130 could be linked via independent drive motors communicating via a wired or wireless connection. That is, booster wheels included in booster wheels 132 might be electronically linked instead of mechanically linked. The same is true of booster wheels 152 and may also apply to linking between wheels 132 and 152.

In a preferred embodiment, the booster wheels 132 and booster wheels 152 are all linked to operate at the same speed so that they impart the same accelerating force to the toy vehicles passing through either the first pathway 120 or the second pathway 140. In instances where multiple vehicles are racing against each other within a track set that includes the lid-integrated toy vehicle booster 200 (see, e.g., FIG. 9), it may be desirable that a toy vehicle does not gain an unfair advantage over other toy vehicles by passing through pathway 120 or pathway 140. Additionally, having both of booster wheels 132, as well as both of booster wheels 152, operating at the same speed ensures that a toy vehicle sized to travel along the first pathway 120 or the second pathway 140 receives the same accelerating force on both sides. Put another way, if the wheels in booster wheels 132 or the wheels in booster wheels 152 operate at different speeds, this may, in certain instances, cause a toy vehicle traveling to spin when exiting the lid-integrated toy vehicle booster 200.

Moreover, although booster wheels 132 and booster wheels 152 are only partially illustrated, it is to be understood that booster wheels 132 and 152 can have any shape, for example, to enhance flexibility, durability, grip, etc. and ensure that booster wheels 132 and 152 can accommodate and engage a toy vehicle passing along pathway 120 or 140 to accelerate the toy vehicle (e.g., to "boost" the toy vehicle). The flexibility of booster wheels 132 and 152 may also allow the booster wheels 132 and 152 to accommodate toy vehicles of slightly varied widths. As one example, booster wheels 132 and/or 152 may have an S-shape that allows the relative distance between the booster wheels 132 and/or 152 to change, as is disclosed in U.S. Pat. No. 7,955,158 to Filoseta et al., which is incorporated by reference in its entirety. Additionally or alternatively, the booster wheels 132 and/or 152 may have a plurality of apertures to allow increase flexibility, as is disclosed in U.S. Pat. No. 6,793,554 to Newbold, which is also incorporated by reference in its entirety.

Still referring to FIGS. 1 and 2, the body portion 110 may also form additional features or housings. For example, in the depicted embodiment, the first external portion 114 defines a compartment 1141 while the second external portion 116 also defines a compartment 1161. During play, toy vehicles can be stored within compartment 1141 and/or compartment 1161 (e.g., the compartments may provide "garages"). Additionally, the central portion 118 can also include a battery compartment 1181 and a control unit housing 1182 to host batteries (not shown) and a control unit 170 of the toy vehicle booster 101, respectively. Generally, the batteries can power the booster assembly 125 and any other electronic components of the toy vehicle booster 101 and the control unit 170 may control the booster assembly 125 in any manner now known or developed hereafter.

In the depicted embodiment, the lid 102 "hosts" the various portions/components of toy vehicle booster 101 by providing recesses within which a body portion of the toy vehicle booster 101 housing these portions/components can be secured (e.g., fixedly secured, such as via fasteners, detent couplings, and/or any other fixedly secured coupling). However, in other embodiments, components of the toy vehicle booster 101 may be incorporated or integrated into lid 102 in any manner. For example, the lid 102 may be formed (e.g., molded) around the booster assembly 125 or around the toy vehicle booster 101. Additionally or alternatively, the booster assembly 125 may be installed within an internal cavity formed within the body portion 110 of the lid 102 and/or secured within coverings (removable or integral coverings).

Now turning to FIG. 2 specifically, in the depicted embodiment, the control unit 170 includes a three-position switch 172 that controls booster 130 and 150. In particular, control unit 170 turns boosters 130 and 150 off and on while also controlling a direction of rotation of at least the first booster 130. However, this is merely one example of a switch that might control booster 130 and/or booster 150 and another example is discussed in detail below in connection with at least FIGS. 7A-7C. Moreover, in other embodiments, control unit 170 may control the direction of rotation of booster 130 and 150 and need not only control the direction of one booster. Nevertheless, the functionality of three-position switch 172 is now described as an example of functionality that may incorporated into lid-integrated toy vehicle booster 100.

First, when three-position switch 172 of the depicted embodiment is disposed adjacent dual forward indicia 1701 (e.g., in a first ON position), the first booster 130 and the second booster 150 will both be driven (e.g., by one or more motors) to accelerate toy vehicles in direction D1 along the first pathway 120 and the second pathway 140, respectively. Second, when three-position switch 172 of the depicted embodiment is in disposed adjacent opposite indicia 1702 (e.g., in a second ON position), the first booster 130 will be driven (e.g., by one or more motors) to accelerate a toy vehicle in direction D2 along the first pathway 120 while the second booster 150 will be driven (e.g., by one or more motors) to accelerate a toy vehicle direction D1 along the second pathway 140. That is, when the three-position switch 172 of the depicted embodiment is in disposed adjacent opposite indicia 1702 (e.g., in a second ON position), the first booster 130 and the second booster 150 accelerate toy vehicles in opposite direction. Third, and finally, when three-position switch 172 of the depicted embodiment is in disposed adjacent off indicia 1703 (e.g., in an OFF position), boosters 130 and 150 will be powered down (e.g., not driven).

Figure 3:
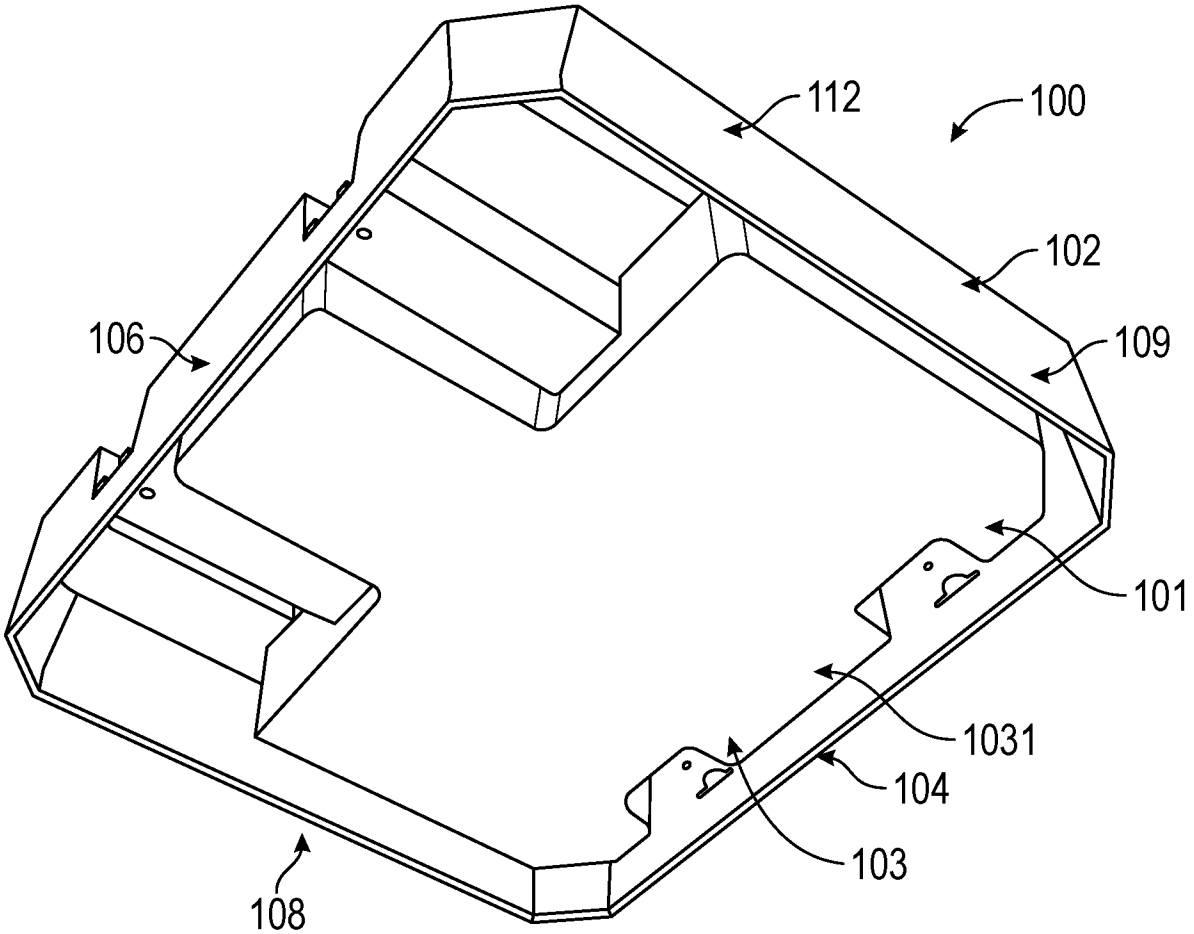
FIG. 3 illustrates a bottom perspective view of the lid-integrated toy vehicle booster of FIG. 1.

Now turning to FIG. 3, but with continued reference to FIGS. 1 and 2, the lid-integrated toy vehicle booster 100 also defines a bottom 103 on which the lid-integrated toy vehicle booster 100 can rest when removed (i.e., decoupled) from container 180. In this particular embodiment, the bottom 103 is defined by a bottom end of a sidewall 112 of the lid 102 and a bottom surface 1031 of the toy vehicle booster 101. Together, the sidewall 112 and bottom surface 1031 define a stable surface upon which the lid-integrated toy vehicle booster 100 can rest. That is, the sidewall 112 and bottom surface 1031 may collectively engage a support surface (e.g., a table or the ground) so that the lid-integrated toy vehicle booster 100 can rest stably on a support surface and boost toy vehicles from a stable position. However, in other embodiments, any part or portion of lid-integrated toy vehicle booster 100 can define a stable surface that can stably support the lid-integrated toy vehicle booster 100 on a support surface.

Now turning to FIGS. 4-7C, the figures illustrate a second example track set 20 that includes a second example embodiment of the lid-integrated toy vehicle booster 200. Generally, track set 20 is substantially similar to track set 10 (e.g., lid-integrated toy vehicle booster 200, toy vehicle booster 201, and lid 202 are each similar to lid-integrated toy vehicle booster 100, toy vehicle booster 101, and lid 102). Thus, any description of functional or structural aspects of track set 10 included herein should be understood to apply to track set 20. Nevertheless, for completeness, some differences between track set 10 and track set 20 are described below (and denoted in the figures with new part numbers). However, the descriptions of track sets 10 and 20 are not intended to limit the track set or lid-integrated toy vehicle booster presented herein in any manner. Instead, track set 10 and track set 20 are presented and described herein to provide two non-limiting examples of the track set and/or the lid-integrated toy vehicle booster presented herein.

Figure 4:
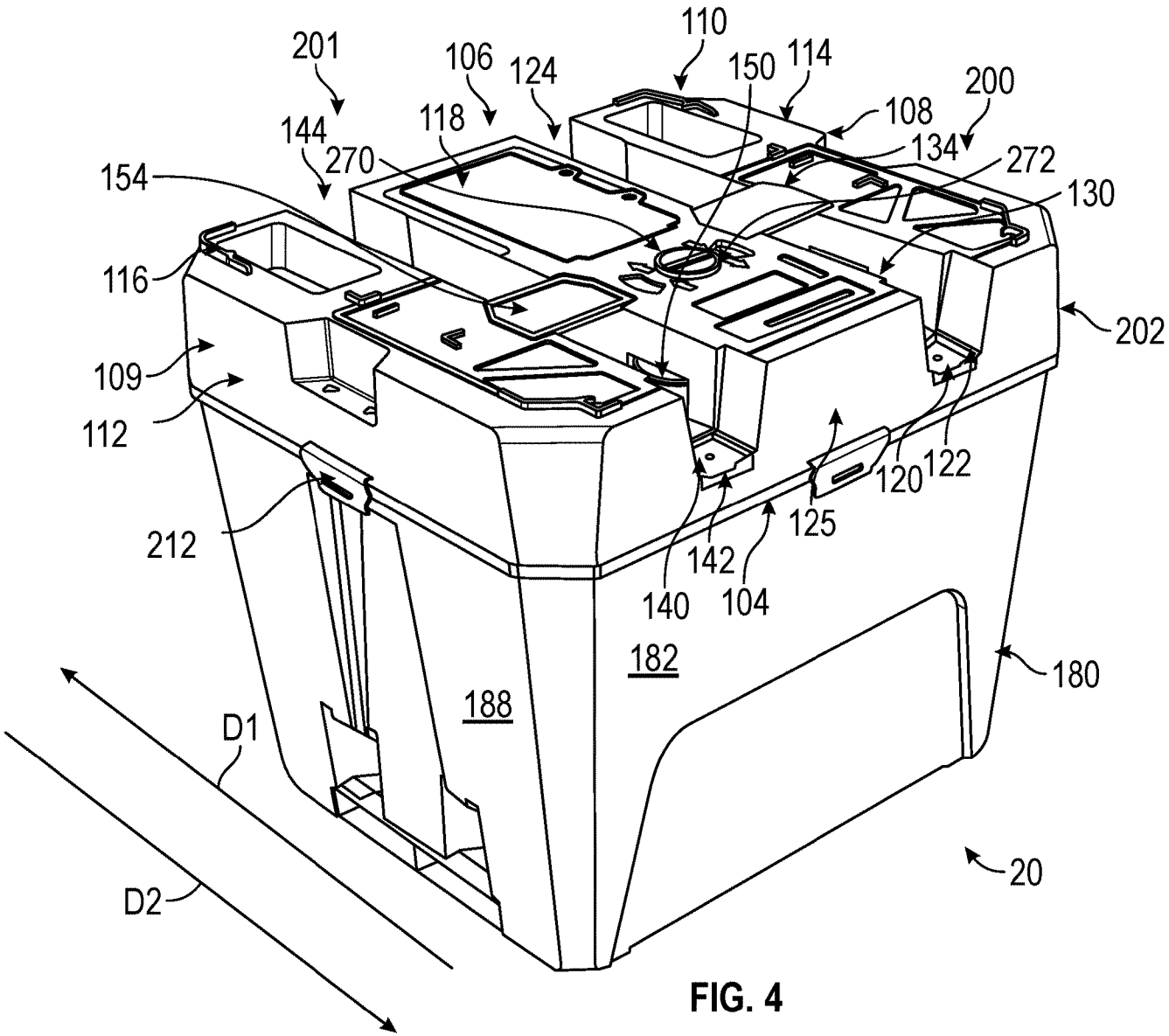
FIG. 4 illustrates a front perspective view of a second toy vehicle track set including a second example embodiment of the lid-integrated toy vehicle booster of the present application.
Figure 5:
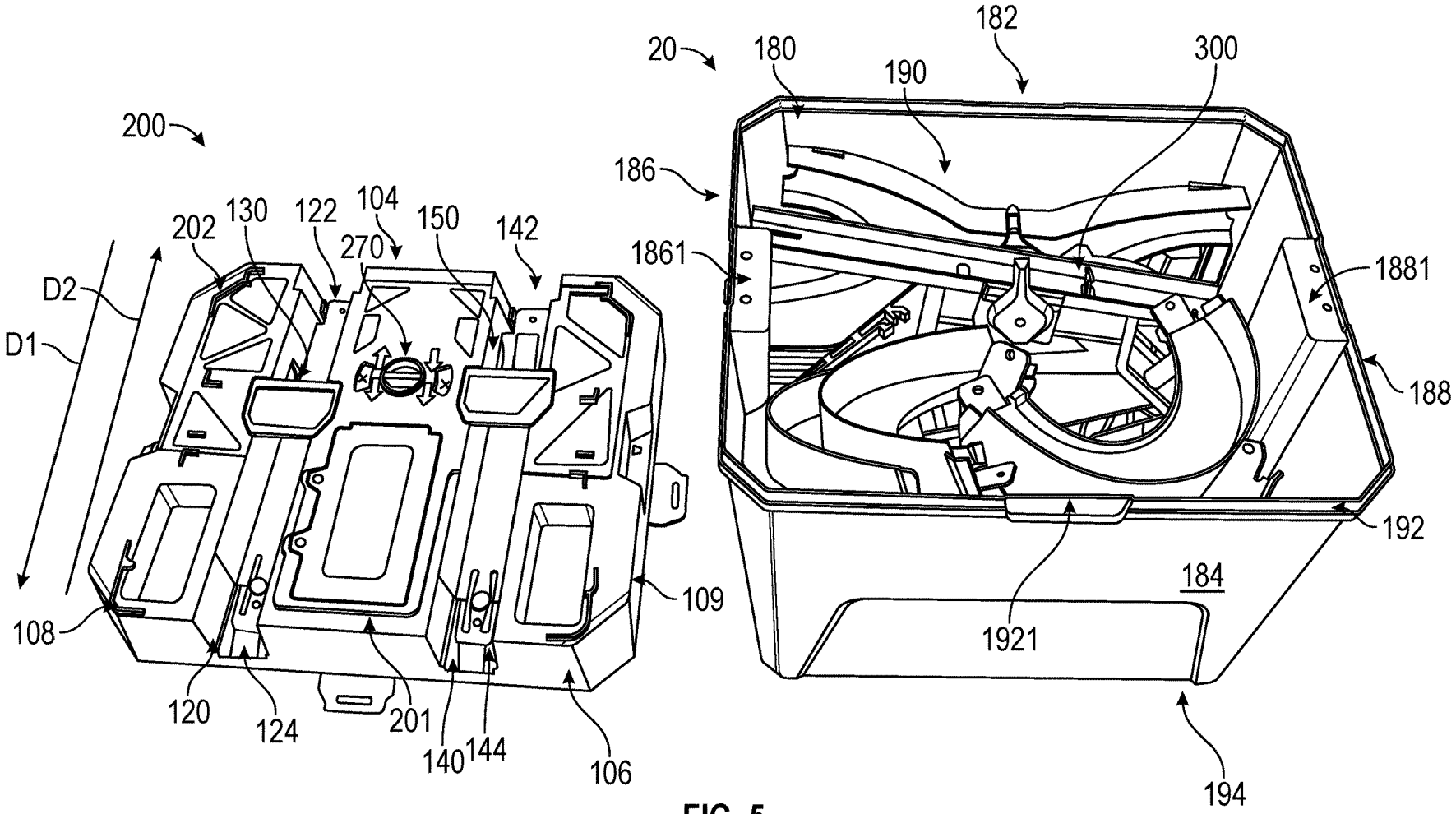
FIG. 5 illustrates a back perspective view of the lid-integrated toy vehicle booster of FIG. 4 while decoupled from a container of the toy vehicle track set.
Figure 6:
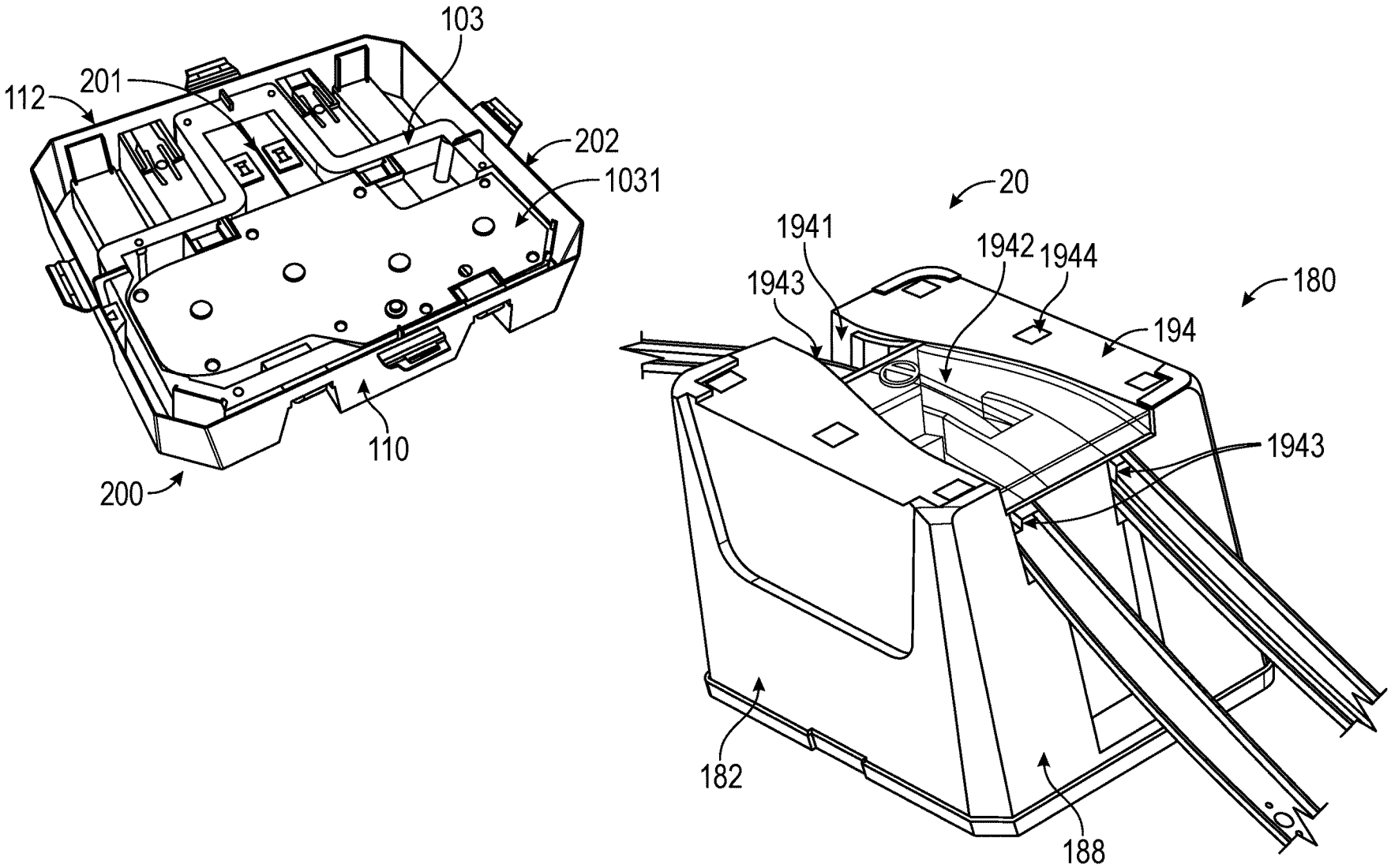
FIG. 6 illustrates perspective views of a bottom of the lid-integrated toy vehicle booster and the container of the toy vehicle track set of FIG. 4.

Moreover, track set 10 and track set 20 each include a similar container, but certain features of the container 180 may be easier to see in FIGS. 4-6. Thus, the container 180 is now described in connection with FIGS. 4-6, but this description should be understood to apply to all of FIGS.

1-6. That said, container 180 is an open-top, rectilinear container with a front 182, a back 184, a right side 186, a left side 188, and a bottom 194. The front 182, back 184, right side 186, and left side 188 define an interior compartment 190 and a top lip 192. The interior compartment 190 can receive and store various track pieces, such as track pieces 300, and toy vehicles, such as toy vehicles 350 (see FIGS. 9-12). The top lip 192 can engage the sidewall 112 of lid 202 (or 102) to removably secure lid 202 (or 102) to the container 180. However, in other embodiments, lid-integrated toy vehicle booster 100 or 200 may be removably coupled to the container 180 in any manner. Thus, the lid-integrated toy vehicle booster presented herein may removably close compartment 190 and provide an enclosed storage space for track pieces and/or toy vehicles that are included in or being used with the track set 10 or track set 20 (e.g., for travel or storage) without requiring any space within compartment 190 be reserved for a booster.

In at least some embodiments, the connection between lid-integrated toy vehicle booster 200 (or lid-integrated toy vehicle booster 100) and container 180 is enhanced by latches that allow the lid-integrated toy vehicle booster 100/200 to be removably coupled to the container 180. For example, in the depicted embodiment, lid 202 include latches 212 and the front 182, back 184, right side 186, and/or left side 188 include corresponding connectors 1921 configured to engage with latches 212. Additionally or alternatively, the front 182, back 184, right side 186, and/or left side 188 may include handles or grips to assist a user with carrying track set 20 (or track set 10). In the depicted embodiment, side 186 includes a handle 1861 and side 188 includes a handle 1881.

As can be seen in FIG. 6, the bottom 194 of the container 180 can include various features that can assist with track building. In particular, the bottom 194 may define or include a Y-path 1941 that is at least partially covered by a cover 1942. The bottom 194 may also define or support connectors 1943 at the exit and entries to the Y-path 1941. The connectors 1943 allow track pieces, such as track pieces 300 to be connected thereto. In this particular embodiment, the Y-path 1941 includes two connectors at its entrance (adjacent side 188) and one connector at its exit (adjacent side 186). Thus, two track paths may enter and one may exit. Additionally, the bottom 194 may include apertures 1944 into which corresponding mounting portions of certain track pieces 300 may be inserted so that the container 180, when inverted, can support certain track pieces 300 in an elevated position.

Figure 7C:
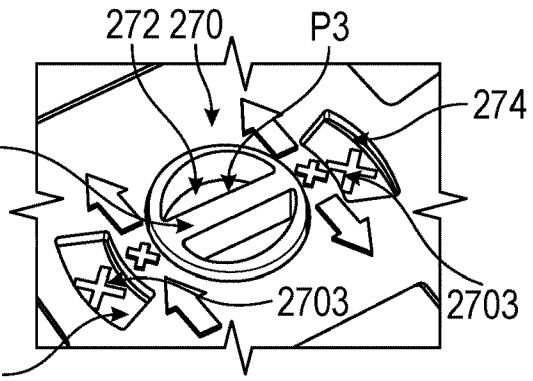
FIGS. 7A-7C illustrate close-up views of a control button included on the lid-integrated toy vehicle booster of FIG. 4 in different control positions.
Figure 7B:
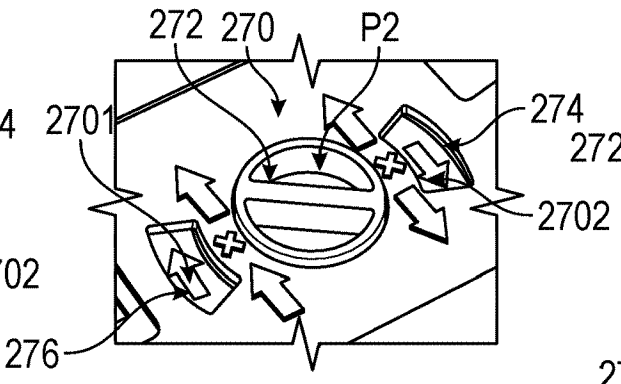
Figure 7A:
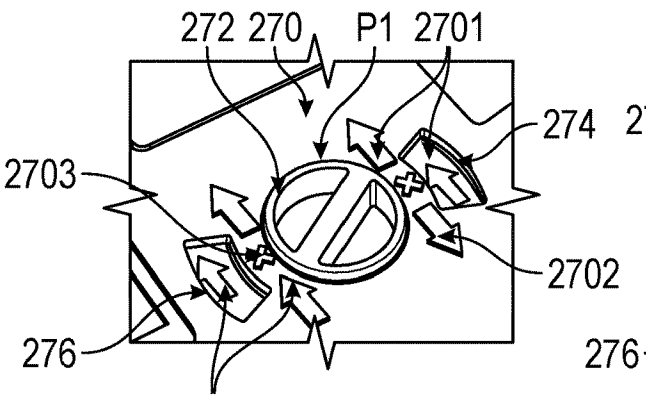

Now turning to FIGS. 7A-7C, but with continued reference to at least FIGS. 4-6, one of the significant differences, if not the only significant difference, between the lid-integrated toy vehicle booster 100 and the lid-integrated toy vehicle booster 200 is the control unit 270. Instead of a three-position switch 172, the control unit 270 of the toy vehicle booster 201 includes a rotatable knob 272 (also referred to as switch 272). The knob 272 includes a pointer 2721 that simultaneously points to or aligns with indicia provided proximate to booster 130 and indicia provided proximate to second booster 150. Like switch 172 switch 272 controls a direction of rotation of at least the first booster 130. Thus, functionally, switch 272 is similar to switch 172, but achieves this functionality with another example configuration, as is detailed below. Additionally, control unit 270 may include a first display 274 associated with the first booster 130 and a second display 276 associated with the second booster 150 to provide an visual indication of a direction in which boosters 130 and 150 are acting (e.g., a visual indication of which direction they are "boosting").

As a more detailed explanation, first, as is shown in FIG. 7A, the knob 272 of the depicted embodiment can be rotated into a first ON position P1 where it aligns with a first forward indicia 2701 for the first booster 130 and a forward indicia 2701 for the second booster 150. When the knob 272 is in position P1, the first booster 130 and the second booster 150 will both be driven (e.g., by one or more motors) to accelerate toy vehicles in direction D1 along the first pathway 120 and the second pathway 140, respectively. Additionally, when the knob 272 is the first ON position P1, displays 274 and 276 may both display the forward indicia 2701.

Next, and as can be seen in FIG. 7B, the knob 272 of the depicted embodiment can be rotated into a second ON position P2 where it aligns with a second forward indicia 2701 proximate the first booster 130 and reverse indicia 2702 proximate the second booster 150. When the knob 272 is disposed in the second ON position P2, the first booster 130 will be driven (e.g., by one or more motors) to accelerate a toy vehicle in direction D2 along the first pathway 120 while the second booster 150 will be driven (e.g., by one or more motors) to accelerate a toy vehicle direction D1 along the second pathway 140. That is, when the knob 272 of the depicted embodiment is in the second ON position P2, the first booster 130 and the second booster 150 accelerate toy vehicles in opposite direction. Additionally, when the knob 272 is in the second ON position P2, first display 274 may display the reverse indicia 2702 and the second display 276 may display the forward indicia 2701.

Finally, and as can be seen in FIG. 7C, the knob 272 of the depicted embodiment can be rotated into a third position P3 (i.e., an OFF position P3) where it aligns with off indicia 2703 proximate both the first booster 130 and the second booster 150. When the knob 272 is disposed in the OFF position P3, boosters 130 and 150 will be powered down (e.g., not driven). Additionally, when the knob 272 is in the OFF position P3, displays 274 and 276 may both display the off indicia 2703.

Figure 8A:
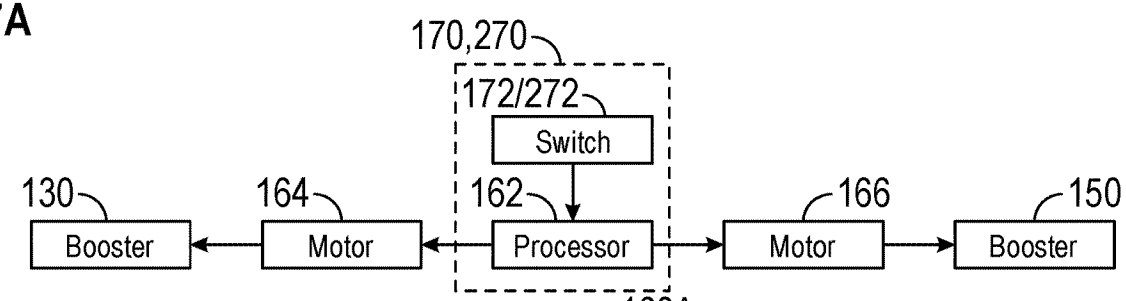
FIGS. 8A and 8B illustrate two example drive systems that may be included in the lid-integrated toy vehicle booster of FIG. 1 or FIG. 4.
Figure 8B:
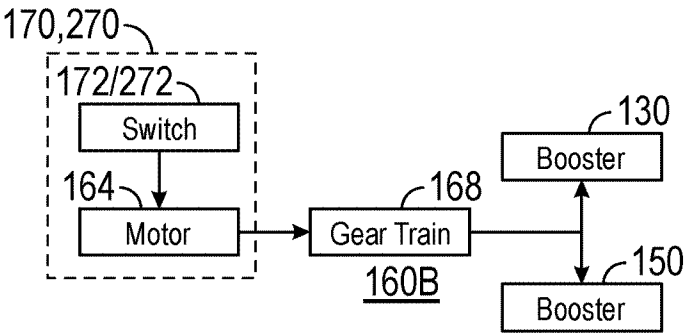

Now turning to FIGS. 8A and 8B, these figures are high-level block diagrams off example electromechanical drive systems that may be included in the lid-integrated toy vehicle booster presented herein. In particular, FIG. 8A depicts a "smart" drive system 160A while FIG. 8B depicts a "dumb" drive system 160B. However, these example drive systems are not intended to be limiting and it is to be understood that each of these drive systems could be used in combination with other elements, connections, components, whether illustrated or not. That is, the various boosters of booster assembly 125 may be driven in any manner, by any drive system, now known are developed hereafter.

That said, in FIG. 8A, the drive system 160A is "smart" because a processor 162 controls the first booster 130 and the second booster 150. In particular, based on an input from switch 172/272, processor 162 controls (e.g., sends a drive signal to) a first motor 164 and a second motor 166 to control a direction in which motor 164 rotates first booster 130 and a direction in which motor 166 rotates second booster 150. In some embodiments, motor 164 is a two-way, reversible motor and motor 166 is a one-way motor. Thus, the processor 162 controls motor 164 by turning it on a certain direction and controls motor 166 by turning it off or on. However, in other embodiments, motors 164 and 166 may both be two-way, reversible motors and both first booster 130 and second booster 150 could be operated in either direction.

By comparison, the drive system 160B is a "dumb" drive system because it does not include a processor. Instead, a gear train 168 is arranged to drive and control the direction of rotation for each of first booster 130 and second booster 150. For example, in some embodiments, actuation of switch 172/272 to a first ON position (e.g., position P1) may cause motor 164 to rotate in a first direction and the gear train 168 may cause this motor rotation to operate the first booster 130 and the second booster 150 in the same direction. Then, actuation of switch 172/272 to a second ON position (e.g., position P2) may cause motor 164 to rotate in a second direction. The gear train 168 may cause this second motor rotation to operate the first booster 130 in a first direction and the second booster 150 in an opposite direction.

Alternatively, although the switch 172/272 is depicted as acting on only the motor 164, the switch 172/272 might, in some embodiments, also act on gear train 168. In these embodiments, moving switch 172/272 to a first ON position (e.g., position P1) could turn on the motor 164 and align a first set of gears from gear train 168 with the motor 164 (to drive boosters 130 and 150 in the same direction) while moving switch 172/272 to a second ON position (e.g., position P2) could turn on the motor 164 and align a second set of gears from gear train 168 with the motor 164 (to drive boosters 130 and 150 in opposite directions). However, drive system 160B is merely one example of a "dumb" drive system and other embodiments might control boosters 130 and 150 in any other way that does not involve a processor, such as by switching electrical circuitry, reversing polarity of magnets, etc.

Now turning to FIGS. 9-12, these figures illustrate various track layouts that can be built with the track set 20. Or, put another way, FIGS. 9-12 illustrate various track layouts in which the lid-integrated toy vehicle booster 200 presented herein may be incorporated. Each track layout is described in turn below.

Figure 9:
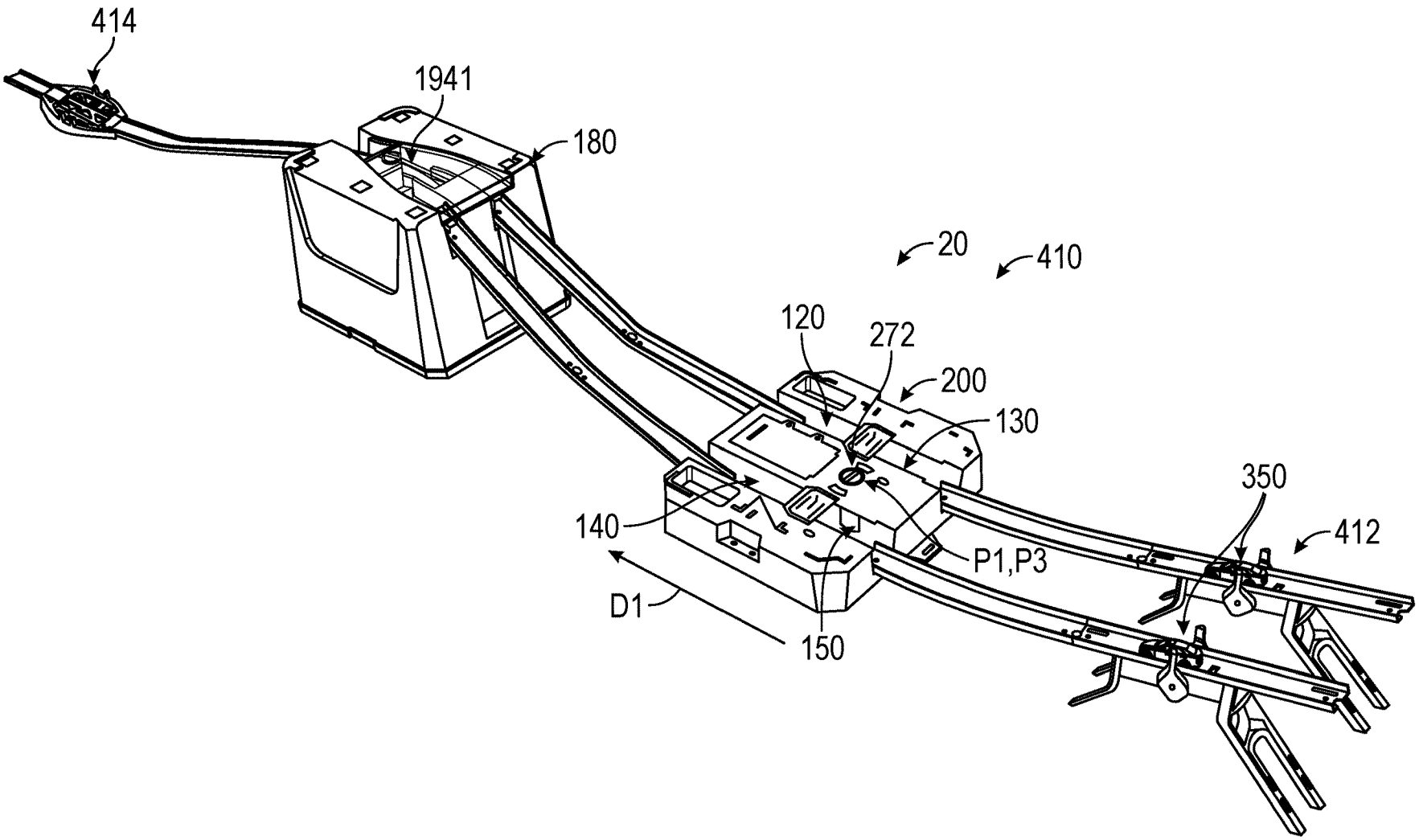
FIGS. 9-12 illustrate four track layouts in which the lid-integrated toy vehicle booster of FIG. 1 or FIG. 4 may be incorporated.

First, FIG. 9 depicts a first layout 410 in which two toy vehicles 350 may race each other from a first end 412 to a second end 414. Both toy vehicles 350 are boosted in direction D1 by the lid-integrated toy vehicle booster 200 and race relatively linearly from a start to a finish. That is, one of toy vehicles 350 is boosted (e.g., accelerated) along first pathway 120 in direction D1 by the first booster 130 and a second vehicle of toy vehicles 350 is boosted (e.g., accelerated) along second pathway 140 in direction D1 by the second booster 150. After being accelerated by lid-integrated toy vehicle booster 200, the toy vehicles 350 converge in the Y-path 1941 included in the bottom 194 of container 180 and, thus, there is a clear "winner" when the toy vehicles 350 exit the Y-path 1941 (whichever car comes out first). Since this track layout races toy vehicles 350 from a start to an end (e.g., an open path instead of a closed loop), a user can rotate knob 272 between its first ON position P1 (which operates boosters 130 and 150 in the same forward direction) and its OFF position P3 between races.

Figure 10:
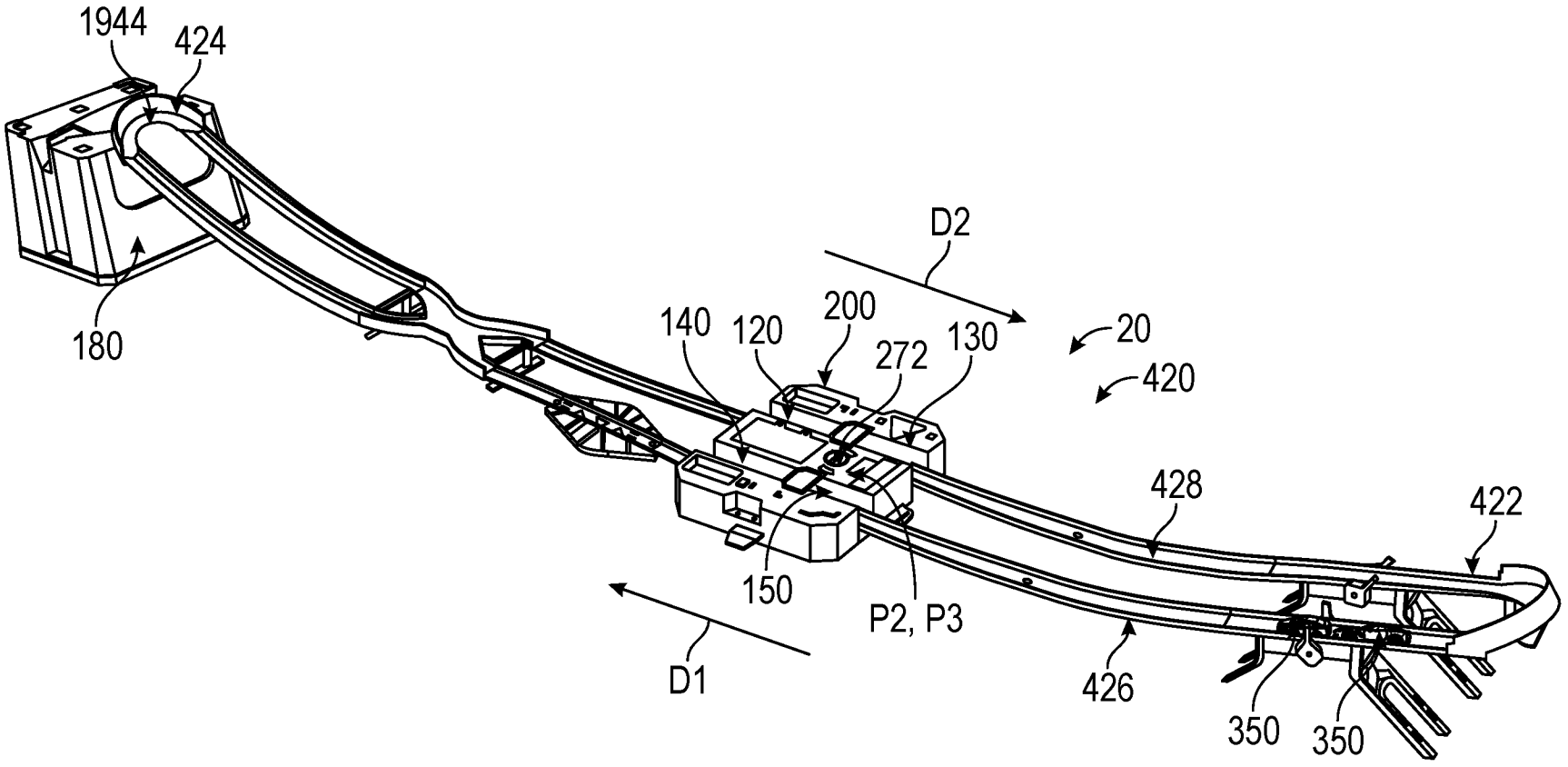

By comparison, FIG. 10 depicts a second track layout 420 that is a closed loop. The loop includes a first turn 422 and a second turn 424 (which is an elevated turn that is supported in an elevated position by an aperture 1944 included on a bottom 194 of container 180) that are connected by a first segment 426 and a second segment 428 (which converge and diverge at an X-track). Since the second track layout 420 is a closed loop, the control knob 272 of the lid-integrated toy vehicle booster 200 can be set to position P2 to cause the lid-integrated toy vehicle booster 200 to boosts (e.g., accelerate) a toy vehicle 350 each time it travels between turn 422 and turn 424. In particular, as a toy vehicle 350 traverses segment 428, the toy vehicle 350 will be boosted along the first pathway 120 in direction D2 by the first booster 130. Then, as the toy vehicle 350 travels along segment 426, the toy vehicle 350 will be boosted (e.g., accelerated) along second pathway 140 in direction D1 by the second booster 150. Since track layout 420 is a closed loop, a user can set knob 272 to its second ON position P2 (which operates boosters 130 and 150 in opposite directions) to continuously boost toy vehicle 350 until a user is done playing with track set 20. Then a user can turn the knob to its OFF position P3.

Figure 11:
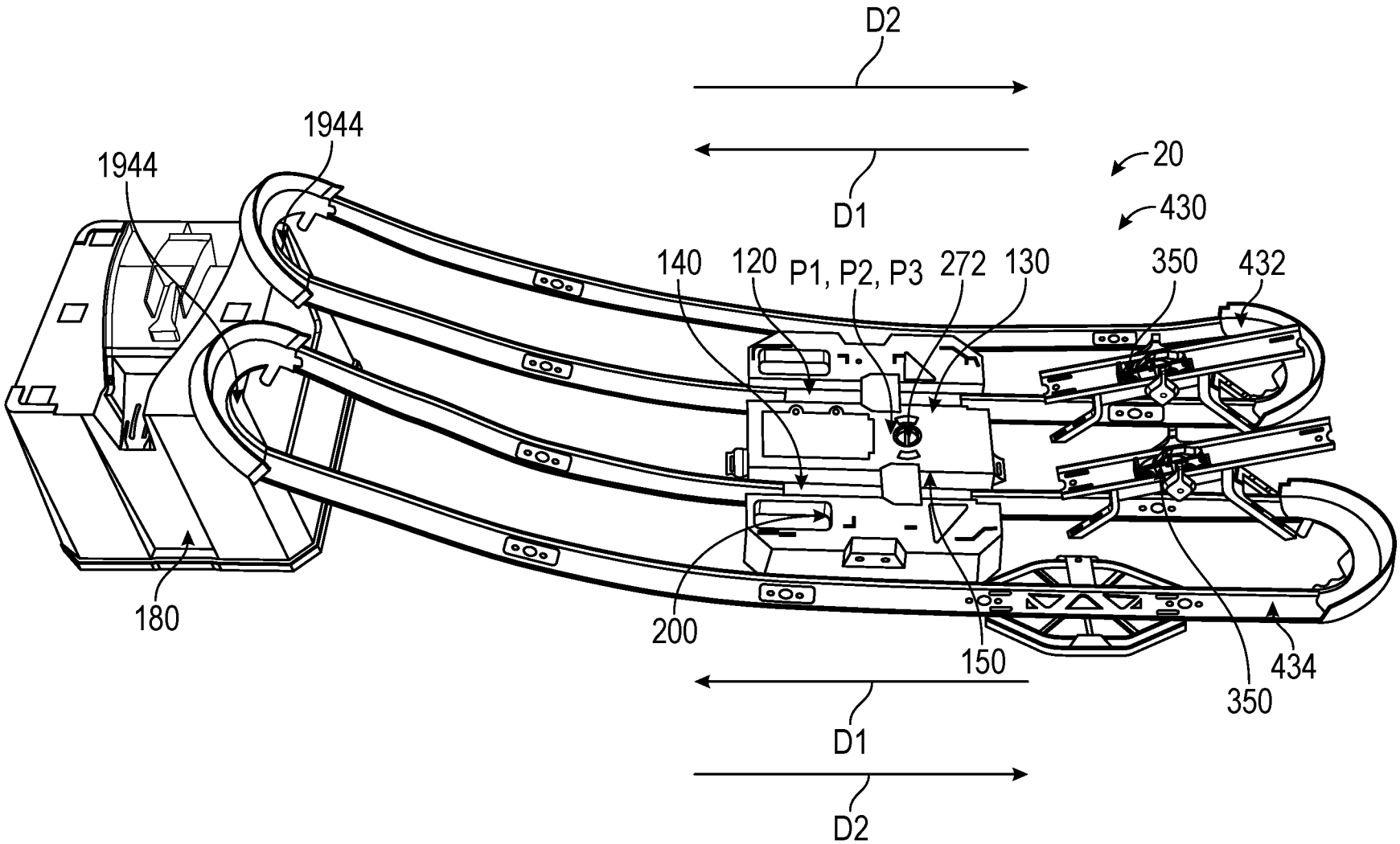
Figure 12:
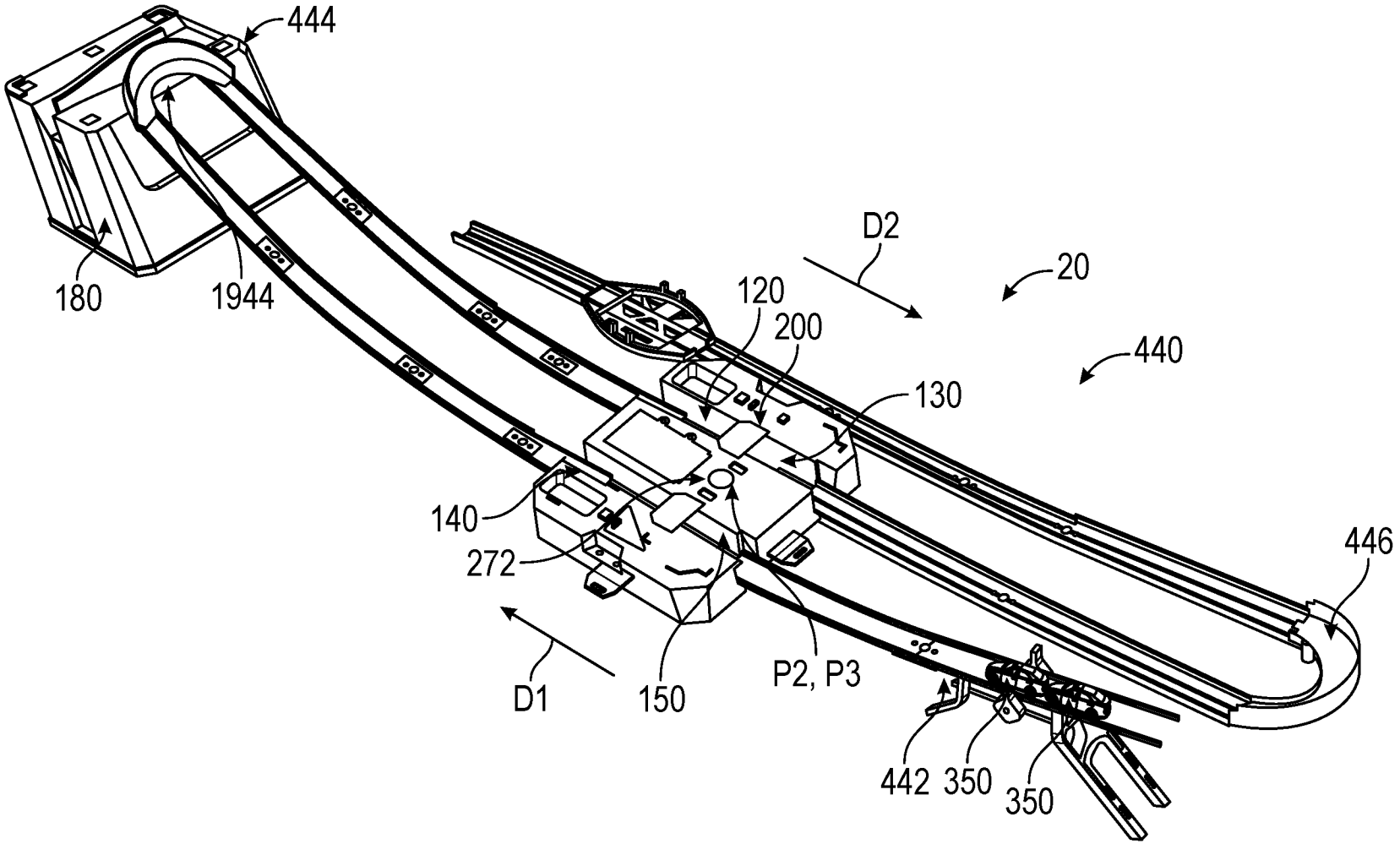

In FIG. 11, track layout 430 provides two closed loops. In particular, track layout 430 includes a first loop 432 that includes or extends through pathway 120 and a second loop 434 that includes or extends through pathway 140. First loop 432 and second loop 434 are independent and, thus, lid-integrated toy vehicle booster 200 can operate each of booster 130 and booster 150 in either direction. That is, a toy vehicle boosted (e.g., accelerated) along first pathway 120 (in direction D1 or D2) may travel continuously around loop 432 as long as booster 130 continues operating in the same direction (barring a malfunction). Similarly, if a vehicle is boosted (e.g., accelerated) along second pathway 140 (in direction D1 or D2), it may travel continuously around loop 434 as long as booster 150 continues operating in the same direction (barring a malfunction). However, boosters 130 and 150 need not operate in the same direction to cause a vehicle to continuously travel around loop 432 or 434. Instead, lid-integrated toy vehicle booster 200 may allow for loop-style racing in any direction (e.g., users or equipment may count laps until one user's vehicles reaches a predetermined goal).

Fourth, and finally, track layout 440 provides another open path layout where toy vehicles 350 can race from a start to a finish. However, in contrast with track layout 410, track layout 440 directs a single toy vehicle through the lid-integrated toy vehicle booster 200 twice as it moves from start to finish. In particular, the lid-integrated toy vehicle booster 200 is arranged so that after traversing a start segment 442, a toy vehicle enters the second pathway 140 while moving in direction D1. Then, the toy vehicle makes a U-turn on turn segment 444 and re-enters the lid-integrated toy vehicle booster 200 along first pathway 120 while moving in direction D2 before moving onto an exit segment 446.

Since the toy vehicle 350 enters pathways 120 and 140 while moving in opposite directions (e.g., from opposite sides of lid-integrated toy vehicle booster 200), the control knob 272 of the lid-integrated toy vehicle booster 200 can be set to position P2 so that the lid-integrated toy vehicle booster 200 boosts (e.g., accelerates) the toy vehicle 350 in opposite directions during its two passes through lid-integrated toy vehicle booster 200. In particular, as the toy vehicle 350 moves from start segment 442 to turn segment 444, the toy vehicle 350 will be boosted (e.g., accelerated) along the second pathway 140 in direction D1 by the second booster 150. Then, as the toy vehicle 350 travels from turn segment 444 to exit segment 446, the toy vehicle 350 will be boosted (e.g., accelerated) along first pathway 120 in direction D2 by the first booster 130. At least because track layout 440 races cars along from a start to an end (e.g., along an open path), a user can rotate knob 272 between its second ON position P2 (which operates boosters 130 and 150 in opposite directions) and its OFF position P3 between races.

As is demonstrated herein, a lid-integrated toy vehicle booster provides a number of advantages. For example, when a booster is integrated into a lid, the booster can be used to seal a travel or transportation container for a track set, without requiring the container to hold the booster. Thus, a user can travel with or store more track than would otherwise be feasible if the booster were also required to be stored in the container. Moreover, an electrically powered lid-integrated toy vehicle booster allows a user to build entertaining track layouts that automatically and/or continuously accelerate toy vehicles, which may be especially important for young children who have trouble actuating hand-actuated boosters or launchers. Still further, when the lid-integrated toy vehicle booster presented herein includes at least one reversible booster, the lid-integrated toy vehicle booster may enable a user to build a wide variety of interesting track layouts, which may provide continuous entertainment and play value for the user, thereby extending the time during which the toy may retain play value for a child.

While the toy vehicle booster presented herein has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. That is, it is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the toy vehicle booster described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

What is claimed is:

1. A lid-integrated toy vehicle booster, comprising:

a lid that is securable to a container to form a storage container; and a booster assembly operable to accelerate toy vehicles, wherein the lid hosts the booster assembly so that the booster assembly forms a portion of a closed compartment when the booster assembly is disposed in the lid and the lid is secured to the storage container, wherein the booster assembly comprises:

a first booster to accelerate a first toy vehicle of the toy vehicles along a first pathway;

a second booster to accelerate a second toy vehicle of the toy vehicles along a second pathway; and a control unit having a first state and a second state, wherein, when the control unit is in the first state, the first booster and the second booster accelerate the toy vehicles in a forward direction, and when the control unit is in the second state, the first booster accelerates the first toy vehicle in the forward direction and the second booster accelerates the second toy vehicle in a rearward direction, opposite the forward direction.

2. The lid-integrated toy vehicle booster of claim 1, wherein the booster assembly is irremovably secured to the lid.

3. The lid-integrated toy vehicle booster of claim 1, wherein the control unit is further configured to turn the first booster and the second booster off and on.

4. The lid-integrated toy vehicle booster of claim 3, further comprising:

a processor configured to control the first booster and the second booster based on user inputs received at the control unit.

5. The lid-integrated toy vehicle booster of claim 1, wherein the first pathway is parallel to the second pathway.

6. The lid-integrated toy vehicle booster of claim 5, wherein the first pathway and the second pathway are each defined by lateral, interior sidewalls of the lid and each extend from a front of the lid to a back of the lid.

7. The lid-integrated toy vehicle booster of claim 1, wherein the first booster comprises a first pair of motor-driven rotating wheels disposed on opposite sides of the first pathway and the second booster comprises a second pair of motor-driven rotating wheels disposed on opposite sides of the second pathway.

8. The lid-integrated toy vehicle booster of claim 7, wherein the first pair of motor-driven rotating wheels are a first linked pair and the second pair of motor-driven rotating wheels are a second linked pair.

9. The lid-integrated toy vehicle booster of claim 7, wherein the first pair of motor-driven rotating wheels and the second pair of motor-driven rotating wheels are linked to each other.

10. The lid-integrated toy vehicle booster of claim 7, wherein the lid comprises:

a first external portion that defines an outer side of the first pathway;

a second external portion that defines an outer side of the second pathway; and a central portion that defines an inner side of the first pathway and an inner side of the second pathway, wherein the first external portion houses a first wheel of the first pair of motor-driven rotating wheels, the second external portion houses a first wheel of the second pair of motor-driven rotating wheels, and the central portion houses a second wheel of the first pair of motor-driven rotating wheels and a second wheel of the second pair of motor-driven rotating wheels.

11. A toy vehicle track set, comprising:

a container for toy vehicle track pieces; and a lid with an integrated booster assembly, the lid being removably coupleable to the container to close the container to define an enclosed storage space for the toy vehicle track pieces, toy vehicles, or both the toy vehicle track pieces and the toy vehicles, wherein the integrated booster assembly comprises:

a reversible booster configured to accelerate a toy vehicle of the toy vehicles along a first pathway in a forward direction and a rearward direction opposite the forward direction; and a second booster configured to accelerate the toy vehicle along a second pathway in the forward direction.

12. The toy vehicle track set of claim 11, wherein a bottom of the container comprises one or more of:

at least one connector to which track segments may be connected; and a pathway along which toy vehicles may travel.

13. The toy vehicle track set of claim 11, further comprising:

one or more track segments that are storable in the enclosed storage space or connectable to the integrated booster assembly for toy vehicles to form a toy vehicle track including the integrated booster assembly.

14. The toy vehicle track set of claim 11, further comprising a control unit configured to control the reversible booster and the second booster based on user inputs.

15. The toy vehicle track set of claim 14, wherein the control unit comprise a processor for controlling the reversible booster and the second booster.

16. The toy vehicle track set of claim 14, wherein the control unit is further configured to turn the reversible booster and the second booster off and on.

17. A toy vehicle track set, comprising:

one or more track pieces that are connectable to form various track layouts and disassembleable for storage;

an open-top container that defines an interior compartment sized to store the one or more track pieces; and a booster operable to accelerate toy vehicles along the various track layouts and configured to close the open-top container to secure the one or more track pieces in the interior compartment for storage, wherein the booster comprises:

a first booster to accelerate a first toy vehicle of the toy vehicles along a first pathway;

a second booster to accelerate a second toy vehicle of the toy vehicles along a second pathway; and a control unit having a first state and a second state, wherein when the control unit is in the first state, the first booster and the second booster accelerate the toy vehicles in a forward direction, and when the control unit is in the second state, the first booster accelerates the first toy vehicle in the forward direction and the second booster accelerates the second toy vehicle in a rearward direction, opposite the forward direction.

18. The toy vehicle track set of claim 17, wherein the first booster comprises a first pair of motor-driven rotating wheels disposed on opposite sides of the first pathway and the second booster comprises a second pair of motor-driven rotating wheels disposed on opposite sides of the second pathway.

19. The toy vehicle track set of claim 18, wherein the booster further comprises:

a first external portion that defines an outer side of the first pathway;

a second external portion that defines an outer side of the second pathway; and a central portion that defines an inner side of the first pathway and an inner side of the second pathway, wherein the first external portion houses a first wheel of the first pair of motor-driven rotating wheels, the second external portion houses a first wheel of the second pair of motor-driven rotating wheels, and the central portion houses a second wheel of the first pair of motor-driven rotating wheels and a second wheel of the second pair of motor-driven rotating wheels.

20. The toy vehicle track set of claim 17, wherein the control unit comprise a processor for controlling the first booster and the second booster.

* * * * *